US006829576B2

(12) United States Patent
Tsai et al.

(10) Patent No.: US 6,829,576 B2
(45) Date of Patent: Dec. 7, 2004

(54) NONLINEAR OPERATION METHOD SUITABLE FOR AUDIO ENCODING/DECODING AND HARDWARE APPLYING THE SAME

(75) Inventors: Tsung-Han Tsai, Changhua Hsien (TW); Chuh-Chu Yen, Tai-Chung (TW)

(73) Assignee: National Central University, Taoyuan (TW)

( * ) Notice: Subject to any disclaimer, the term of this patent is extended or adjusted under 35 U.S.C. 154(b) by 159 days.

(21) Appl. No.: 10/273,770

(22) Filed: Oct. 18, 2002

(65) Prior Publication Data

US 2004/0057701 A1 Mar. 25, 2004

(51) Int. Cl.[7] ..... G10L 19/00

(52) U.S. Cl. ..... 704/200.1; 704/229; 704/503; 704/230; 704/219

(58) Field of Search ..... 704/230, 229, 704/219, 200.1, 500–504

(56) References Cited

U.S. PATENT DOCUMENTS

| | | | | |
|---|---|---|---|---|
| 5,956,674 A | * | 9/1999 | Smyth et al. | 704/200.1 |
| 5,974,380 A | * | 10/1999 | Smyth et al. | 704/229 |
| 6,226,616 B1 | * | 5/2001 | You et al. | 704/500 |
| 6,266,644 B1 | * | 7/2001 | Levine | 704/503 |
| 6,704,706 B2 | * | 3/2004 | Wu et al. | 704/230 |

OTHER PUBLICATIONS

"A High Quality Re–quantization/Quantization Method for MP# and MPEG–4 AAC Audio coding" Tsung–Han Tsai and Chuh–Chu Yen/Department of Electrical Engineering, National Central University of Taiwan.

* cited by examiner

*Primary Examiner*—Vijay Chawan
(74) *Attorney, Agent, or Firm*—J.C. Patents

(57) ABSTRACT

A nonlinear operation method suitable for audio encoding/decoding and an applied hardware thereof. The nonlinear operation method suitable for audio encoding exists in a quantization process for the audio encoding. The nonlinear operation equation is $f(X)=X^{3/4}$, where X represents the frequency-field data. The method comprises following steps. Building a query table that comprises the frequency-field data X and the corresponding value f(X) that corresponds to the frequency-field data X, wherein the query table is represented as a function T(X), and $T(X)=X^{3/4}$, $1 \leqq X \leqq S$, where S represents a data range included in the query table. Analyzing and providing a modified error quantity function $f_a(z)$ represented by an equation of power of 2, where $$z = \left\lfloor \frac{X}{16^n} \right\rfloor,$$

n=1, 2 or 3, so that z falls in the data range S. When the frequency-field data X intended to be queried is greater than the data range S, the value of T(z) and T(z+1) are obtained from the query table and defined as $Y_1$ and $Y_2$, respectively. The value of the f(X) corresponding to any one of the frequency-field data X outside the data range S is subsequently calculated by using the two-phase interpolation method.

12 Claims, 8 Drawing Sheets

FIG. 4A
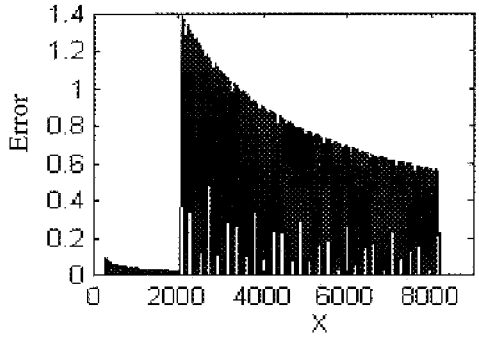
FIG. 4B
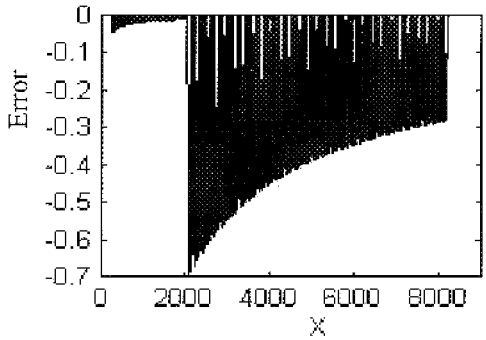
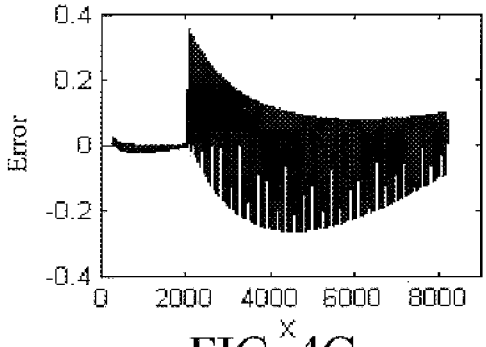
FIG. 4C

NONLINEAR OPERATION METHOD SUITABLE FOR AUDIO ENCODING/DECODING AND HARDWARE APPLYING THE SAME

BACKGROUND OF THE INVENTION

1. Field of Invention

The present invention generally relates to a high quality quantizing/inverse-quantizing algorithm suitable for audio encoding/decoding and t same, and more particularly, to a method that performs a nonlinear operation in the quantization/anti-quantization of the audio encoding/decoding and the hardware applying the same.

2. Description of Related Art

Digital audio signal processing is widely applied now. Noise immunity capability of digital audio signals such as the video telephone, the videoconference, and the multimedia system are stronger than that of analog audio signals. However, since quite often a great amount of data is processed in a very short time frame, but still has to maintain high quality, good audio signal compression and decoding techniques have become inevitable. The motion picture experts group (MPEG) is well accepted now due to its high compression and low distortion rate.

FIG. 1A schematically shows an MPEG encoding process. In the encoding process, the analysis subband filter bank 100 is used to process the digital audio data that represents the time-amplitude relationship to generate the 32 subband frequency-field data that represent the frequency-amplitude. The data with different band is subsequently assigned a different bit according to the psycho-acoustical model 110, and then the quantization 120 is processed to achieve the objective of the frequency-filed data compression. Finally, the compressed data is sent out with a data format of certain framing.

FIG. 1B schematically shows an MPEG decoding process. The decoding process is just like an inverse operation of the encoding process. In the decoding process, the data is unpacked 200 as compressed data first, and subsequently decompressed by inverse quantization 210, and finally the synthesis subband filter bank 220 is used to integrate the data with 32 subbands to generate the original digital audio data.

Nonlinear operation is needed in both the process of the quantization for the MPEG encoding and the process of the inverse quantization for the MPEG decoding. In other words, the non-integer exponential operation is performed to amplify or compress the energy corresponding to the sampling point of the frequency.

FIG. 2A schematically shows an exponential operation equation curve of the quantization that is shown below, and FIG. 2B schematically shows an exponential operation equation curve of the inverse quantization that is shown below.

⊙ The exponential operation equation for the MPEG quantization process: $f(X)=X^{3/4}$ Where X represents the amplitude of the frequency sampling point, i.e. the frequency-field sampling data, and f(X) is the amplified or the compressed sampling data of the frequency-field.

⊙ The exponential operation equation for the MPEG inverse quantization process:

$$f(X)=X^{4/3}$$

Where X represents the inverse package data, and f(X) is the corresponding value of the inverse package data.

Although the exponential operation equation mentioned above can be directly calculated via the software, it is very difficult to implement it by using the hardware (since it is a non-integer exponential operation). Therefore, there is a method for building up the corresponding table, so that the value of the corresponding f(X) can be obtained from a table via a query operation after the frequency-field sampling data X is input. However, this method can only deal with a certain range of the frequency-field sampling data. If it is assumed that 256 frequency-field sampling data X and the value of each corresponding f(X) have been built up, the value of the corresponding f(X) of the frequency-field sampling data can be obtained only when X is in a range of 1~256. If X is beyond 256, the value of the corresponding f(X) of the frequency-field sampling data cannot be obtained via the query operation.

The corresponding table has to be expanded to solve the problem mentioned above. However, it increases the hardware cost and the hardware volume of the integrated circuit. Therefore, some algorithms have been disclosed to solve the insufficiency of the corresponding table. These algorithms approach the nonlinear equations mentioned above by using the estimation method. However, these algorithms will generate error or may need to add an additional multiplier circuit.

SUMMARY OF THE INVENTION

Therefore, the present invention provides a nonlinear operation method suitable for the audio encoding/decoding and the hardware applying the same. The corresponding table does not have to be expanded increasing the hardware cost and having the integrated circuit volume become larger and neither is it necessary to add an additional multiplier for reducing error.

The present invention provides a nonlinear operation method suitable for the audio encoding/decoding. The method exists in a quantization process for the audio encoding. The nonlinear operation equation is $f(X)=X^{3/4}$, where X represents the frequency-field data. The method comprises the following steps. Building a query table that comprises the frequency-field data X and the corresponding value f(X) that corresponds to the frequency-field data X. The query table is represented as a function T(X), and $T(X)=X^{3/4}$, $1 \leqq X \leqq S$, where S represents a data range included in the query table. Analyzing and providing a modified error quantity function $f_a(z)$ represented by an equation of power of 2, where $$z = \left\lfloor \frac{X}{16^n} \right\rfloor,$$

n=1, 2 or 3, so that z falls in the data range S. When the frequency-field data X intended to be queried is greater than the data range S, the value of T(z) and T(z+1) are obtained from the query table and defined as $Y_1$ and $Y_2$, respectively. The value of f(X) corresponding to any one of the frequency-field data X outside the data range S is subsequently calculated by using the two-phase interpolation method.

The present invention further provides a nonlinear operation method suitable for the audio decoding. The method exists as a process of inverse quantization for the audio decoding. The nonlinear operation equation is $f(X)=X^{4/3}$, where X represents the inverse package data. The method comprises the following steps. Building a query table that comprises a plurality of inverse package data X and a corresponding value f(X) that corresponds to the inverse package data X. The query table is represented as a function T(X), and $T(X)=X^{4/3}$, $1 \leqq X \leqq S$, where S represents a data range included in the query table. Analyzing and providing a modified error quantity function $f_a(z)$ represented by an equation of power of 2, where $$z = \left\lfloor \frac{X}{8^n} \right\rfloor,$$

n=1 or 2, so that z falls in the data range S of the query table. When the inverse package data X intended to be queried is greater than the data range S, the value of T(z) and T(z+1) are obtained from the query table and defined as $Y_1$ and $Y_2$, respectively, where z and (z+1) respectively fall in the data range S of the query table. Afterwards, the value of f(X) corresponding to any one of the inverse package data X outside the data range S is calculated by using a two-phase interpolation method.

The present invention further provides an applied hardware for the nonlinear operation equation suitable for the audio encoding/decoding. The applied hardware is in an MPEG integrated circuit and is used to solve a nonlinear operation equation that is needed in the process of quantization/inverse quantization. The applied hardware for the nonlinear operation equation suitable for the audio encoding/decoding comprises a shifter, a read only memory (ROM), a difference calculator, a modified error quantity function generator, and an interpolation method calculator.

The shifter receives the sampling data X, applies the right-shift operation on the received sampling data X to obtain the operation sampling data z, and further has the operation sampling data z fall in the data range S. The read only memory stores a query table that includes the data range S, wherein the query table is represented as a function T(X). After the read only memory receives the operation sampling data z, the value of T(z) and T(z+1) are output and defined as $Y_1$ and $Y_2$, respectively, where z and (z+1) respectively fall in the data range S of the query table. The difference calculator coupled to the read only memory obtains a difference value of $(Y_2-Y_1)$ after receiving $Y_1$ and $Y_2$, and performs a power of 2 operation onto the difference value to obtain an original difference. The modified error quantity function generator coupled to the shifter obtains a modified error quantity function $f_a(z)$ via the subtraction and the shift operation after receiving the operation sampling data z. The interpolation method calculator receives the original difference and the modified error quantity function $f_a(z)$ mentioned above, performs the summation/subtraction operation, selection process, coefficient multiply operation, and shift operation to obtain the nonlinear operation value corresponding to the sampling data X.

In summary, the present invention performs the two-phase interpolation method by using some simple adder or shift circuit under the fixed size of the corresponding table, so that the error can be reduced without adding any additional new multiplier circuit.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention. In the drawings, FIGS. 1A and 1B schematically show a block flow chart of an MPEG encoding process and a block flow chart of an MPEG decoding process, respectively;

FIG. 4A schematically shows an error statistic graph generated by the algorithm 1 based on different values of X;

FIG. 4B schematically shows an error statistic graph generated by the algorithm 2 based on different values of X;

FIG. 4C schematically shows an error statistic graph generated by the present invention based on different values of X;

DESCRIPTION OF THE PREFERRED EMBODIMENTS

MPEG-I can be further divided into three processes, Layer1, Layer2 and Layer3, by using different levels of the audio quality and compression methods. Generally speaking, the higher the layer's level, the more complicated the compression method. Moreover, the higher the layer's level, the less the distortion of the audio signal that is recovered, and the better the performance.

Besides providing multichannel audio encoding, the standard of the MPEG-II audio encoding is basically the same as the standard of the MPEG-I audio encoding. Multichannel audio can be divided into two portions, one portion is the left (L) sound channel and the right (R) sound channel transmitted by the basic transmission channel T0, T1; the other portion is the center (C) sound channel, the left surround (LS) sound channel and the right surround (RS) sound channel transmitted by the extended transmission channel T2, T3, T4. A multichannel decoder is needed for the MPEG-II audio decoding to rebuild the multichannel audio signal.

The MPEG-I Layer3 (MP3) compression standards has been widely used in digital broadcast and multimedia applications. In addition, the new developed MPEG ACC will replace the MP3 and become the mainstream of the digital data compression format in the near future since its compression ratio is better than the MP3 compression ratio, and its quality is better than MP3's quality under the same compression ratio.

The process of the quantization and inverse quantization are needed in the encoding and decoding process for all the MPEG-I, MPEG-II or MPEG-ACC compression formats. However, there is a nonlinear operation, i.e. a non-integer exponential operation that is major and most difficult to solve, in the process of the quantization and inverse quantization, wherein:

⊙ The exponential operation equation for the MPEG quantization process: $f(X) = X^{3/4}$ Where X represents the amplitude of the frequency sampling point, i.e. the frequency-field sampling data, and f(X) is the amplified or the compressed frequency-field sampling data.

⊙ The exponential operation equation for the MPEG inverse quantization process:

$$f(X)=X^{4/3}$$

Where X represents the inverse package data, and f(X) is the corresponding value of the inverse package data.

Regarding the methods for obtaining the solution of the non-integer exponential operation equation mentioned above, besides the query table method that has a more accurate value of f(X), the rest obtain the curve of the equation mentioned above via the estimation by using the linear approach method. These algorithms are used to estimate the value corresponding to the X that is outside the range of the query table. Therefore, the value of f(X) estimated by some algorithms has the disadvantages of oversized error (represented by the algorithm 1 below) or the poor hardware implementation (represented by the algorithm 2 below).

Figure 1A:
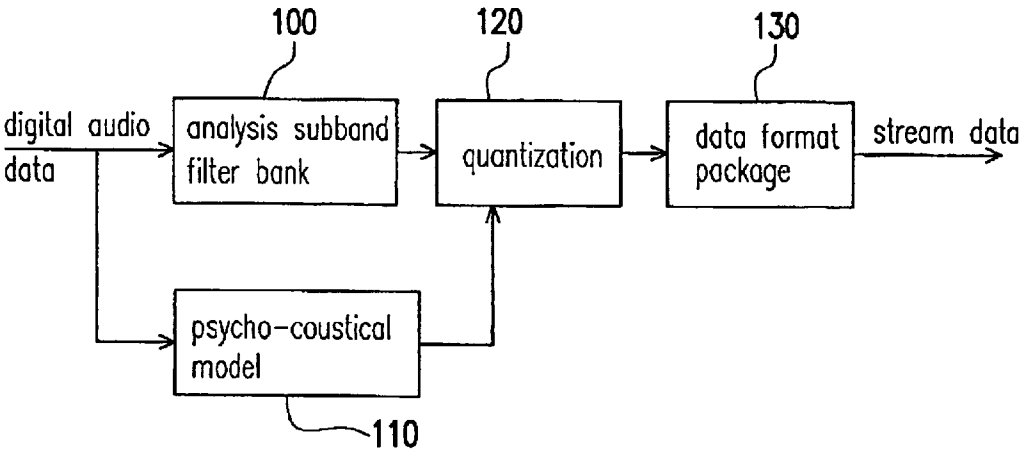
FIG. 1A(PRIOR ART)
Figure 1B:
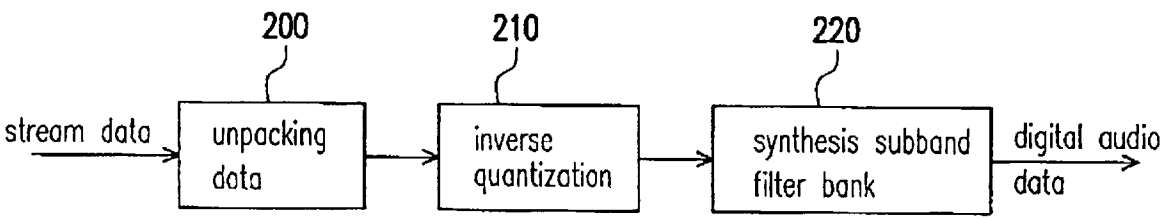
FIG. 1B(PRIOR ART)
Figure 2A:
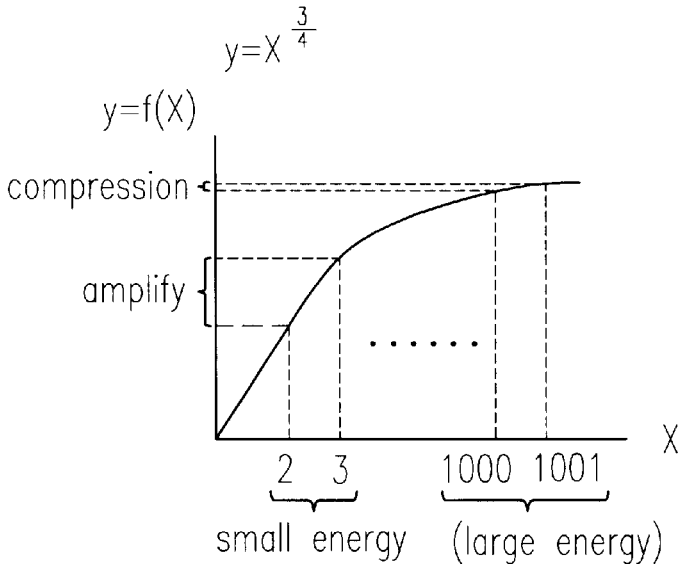
FIG. 2A(PRIOR ART)
FIGS. 2A and 2B schematically show a graph of an exponential operation equation for the quantization process and a graph of an exponential operation equation for the inverse quantization process, respectively.
Figure 2B:
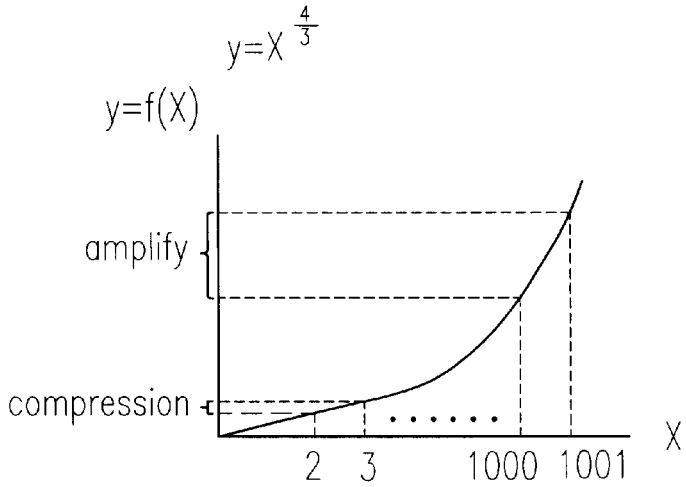
FIG. 2B(PRIOR ART)
Figure 3:
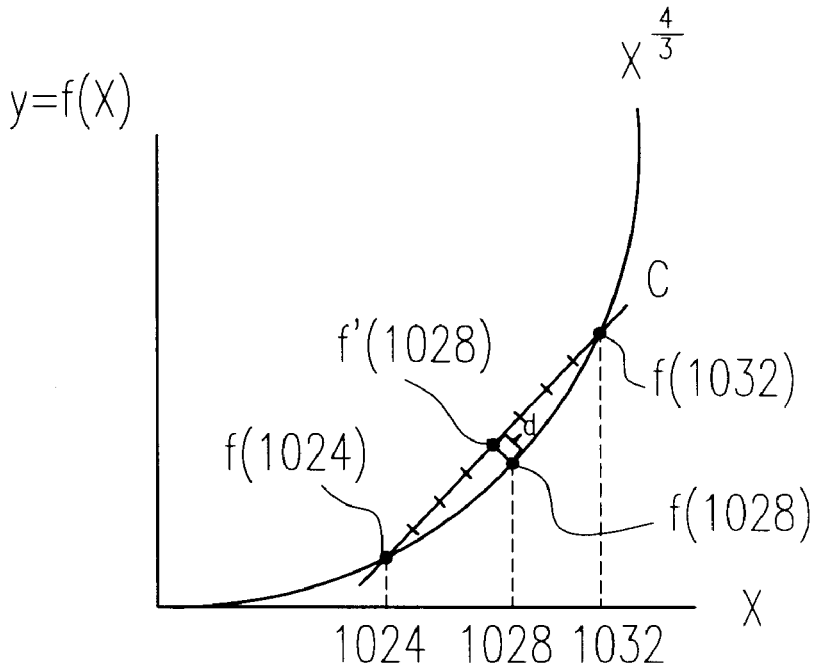
FIG. 3 (PRIOR ART)
FIG. 3 schematically shows a graph of an example of the non-integer exponential equation $f(X)=X^{4/3}$ in the process of the inverse quantization.

FIG. 3 schematically shows a graph to deduct the algorithm 1. Since the non-integer is the only portion that is different between the non-integer exponential equation for the quantization and the non-integer exponential equation for the inverse quantization process, the non-integer exponential equation $f(X)=X^{4/3}$ for the inverse quantization is exemplified in FIG. 3 and the descriptions below.

The concept of the present algorithm (that is also the concept of the present invention) is to have the data range of X that is beyond the range that can be recorded by the query table, fall into the range of the query table, so that the corresponding value of f(X) can be obtained.

For example:

$X^{4/3}$ can be equal to $$\left[\frac{X}{8}\times 8\right]^{\frac{4}{3}},$$

8 is further pulled out to have $$\left[\frac{X}{8}\right]^{\frac{4}{3}}\times 16$$

It is assumed that the query table is a table including the built-in X=1~256 and the value corresponding to it in the real case. If it is intended to search a value of f(1024) that corresponds to X=1024, since 1024 is beyond the value of X that can be recorded by the query table, the value of f(1024) cannot be obtained by directly querying from the query table. At this moment, $1024^{4/3}$ is translated to $$\left[\frac{1024}{8}\times 8\right]^{\frac{4}{3}}=\left[\frac{1024}{8}\right]^{\frac{4}{3}}\times 16=128^{\frac{4}{3}}\times 16$$

The value of f(128) corresponding to X=128 is obtained by querying from the query table, and the value of f(128) is subsequently multiplied by a recover coefficient 16 to obtain the value of $1024^{4/3}$.

Since the query table records the value of f(X) corresponding to the serial data X that all have a difference value of 1, when the method mentioned above is applied to search the value of X=1028, the corresponding value cannot be found directly. The value of f(1024) and f(1032) corresponding to X=1024 (1024/8=128) and X=1032 (1032/8=129) must be obtained respectively by using the method mentioned above first, then applying the interpolation method to obtain the value of f'(1028) that corresponds to X=1028 (as shown in FIG. 3). However, since the algorithm 1 approaches the curve of $X^{4/3}$ with a secant C, it may not be error-free. It is known from FIG. 3 that a maximum error value d exists between the f'(1028) obtained previously and the f(1028) on the curve of $X^{4/3}$. Therefore, the corresponding value of f'(X) deducted by the algorithm 1 has maximum error value in average.

Therefore, algorithm 2 is used to improve algorithm 1 to obtain a more accurate corresponding value f'(X). Although algorithm 2 uses the method of querying the query table and the interpolation method to obtain the corresponding value f'(X) the same as algorithm 1, the query table built up by algorithm 2 is the query table of $X^{1/3}$, and the conceptual implementation is as below:

$X^{4/3}$ is translated to $$X^{\frac{1}{3}}\times X=\left[\frac{X}{8}\times 8\right]^{1/3}\times X=\left[\frac{X}{8}\right]^{1/3}\times 2\times X$$

Therefore, the f'(X) that is just obtained can be getting close to $X^{4/3}$. After querying the query table, the value obtained has to be multiplied by the recover coefficient 2, and further multiplied by the recover variable X. Although it can reduce the error quantity when compared with the algorithm 1, a complicated multiplier circuit is further needed.

FIG. 4A schematically shows the error values generated by algorithm 1 based on different values of X.

FIG. 4B schematically shows error values generated by algorithm 2 based on different values of X.

FIG. 4C schematically shows error values generated by the present invention based on different values of X.

It is known from FIGS. 4A, 4B and 4C that FIG. 4A (i.e. algorithm 1) has widest range of the error value, the range is up to 1.4, and the error value of FIG. 4B (i.e. the improved algorithm 2) is only the half value of the algorithm 1 (0.7). Therefore, the error value of the present invention is within the range of 0.7. Moreover, the present invention does not need the complicated multiplier circuit to perform the operation.

Figure 5A:
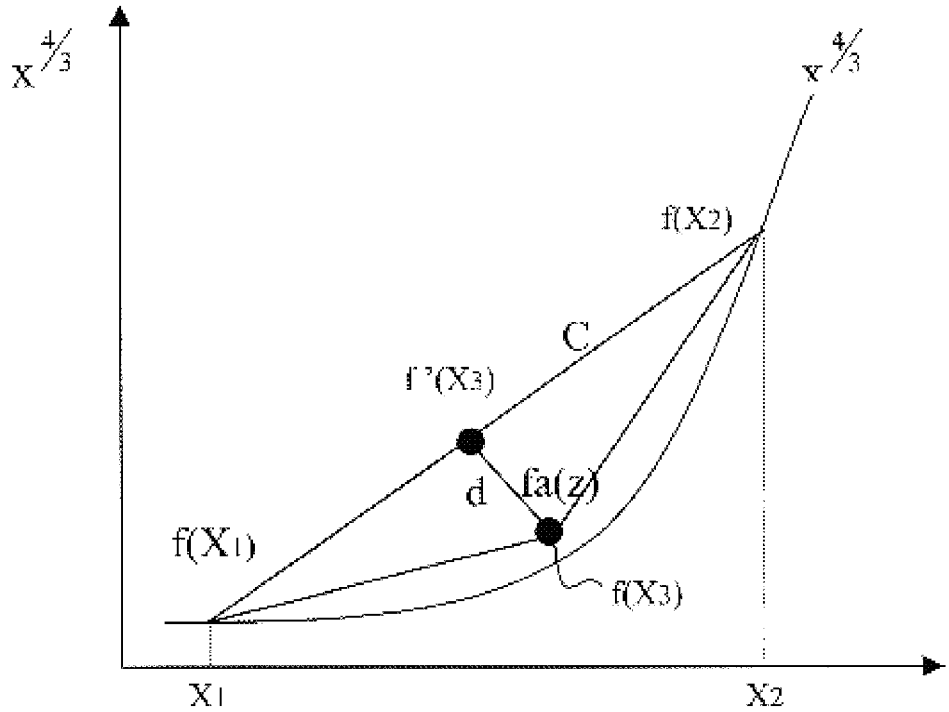
FIG. 5A schematically shows a conceptual graph of a nonlinear operation method suitable for the audio decoding according to the present invention.

The present invention provides a nonlinear operation method suitable for the audio decoding. The implementation concept is shown in FIG. 5A. The present invention tries to reduce the maximum error quantity between the curve of $X^{4/3}$ and the secant C used by algorithm 1 as much as possible. In other words, the modified error quantity function $f_a(z)$ represented by the power of 2 equation is used to estimate the maximum error quantity d in the interval $[X_1, X_2]$, so that the maximum error quantity d can be further eliminated. Moreover, f(X1) to f(X2) can be further divided into two segments to obtain the value of $f(X_3)$ that has a minimum error value. Afterwards, the corresponding value f(X) of any frequency-field data X in the interval $[X_1, X_3]$ can be obtained by using the interpolation method, and the corresponding value f(X) of any frequency-field data X in the interval $[X_3, X_2]$ can also be obtained by using the interpolation method. This is the so-called two-phase interpolation method. It is apparent from FIG. 5A that the algorithm of the present invention can approach more to the curve of $X^{4/3}$.

The two-phase interpolation method equation used in the quantization process of the algorithm according to the present invention is shown below:

$$f(X) = \frac{1}{16^n} \times \left(8^n(Y_2 - Y_1) - 2f_a\left(\left\lfloor \frac{X}{16^n} \right\rfloor\right)\right) \times \mathrm{rem}\left(\frac{X}{16^n}\right) + Y_1 \times 8^n$$

$$\text{for } \mathrm{rem}\left(\frac{X}{16^n}\right) \le \frac{16^n}{2}$$

$$f(X) = \frac{1}{16^n} \times \left(8^n(Y_2 - Y_1) + 2f_a\left(\left\lfloor \frac{X}{16^n} \right\rfloor\right)\right) \times \left(\mathrm{rem}\left(\frac{X}{16^n}\right) - 16^n\right) + Y_2 \times 8^n$$

$$\text{for } \mathrm{rem}\left(\frac{X}{16^n}\right) > \frac{16^n}{2}$$

Wherein having $$z = \left\lfloor \frac{X}{16^n} \right\rfloor,$$

n=1, 2, or 3, to have z fall in the data range S of the query table, and the function rem( ) represents the remainder-extraction operation. In addition, $$\frac{1}{16^n}$$

is the coefficient that is obtained by dividing the line segment linearly approached via the interpolation method into $16^n$ portions.

When the frequency-field data X intended to be queried is greater than the data range S, the value of T(z) and T(z+1) are founded from the query table and defined as $Y_1$ and $Y_2$, respectively, wherein z and (z+1) respectively fall in the data range S of the query table. Afterwards, $Y_1$ and $Y_2$ are further multiplied by a recover coefficient (here it is $8^n$) to respectively obtain the physical corresponding value of $X_1$ and $X_2$, i.e. f(X1) and f(X2). The maximum error quantity d in the interval $[X_1, X_2]$ is eliminated via the secant equation between two points of f(X1) and f(X2) and the modified error quantity function $f_a(z)$ provided by the present invention. The range from f(X1) and f(X2) is further divided into two segments to obtain the value of $f(X_3)$ that has the minimum error value, and the two-phase interpolation method is further performed.

The two-phase interpolation method equation used in the inverse quantization process of the algorithm according to the present invention is shown below:

$$f(X) = \frac{1}{8^n} \times \left(16^n(Y_2 - Y_1) - 2f_a\left(\left\lfloor \frac{X}{8^n} \right\rfloor\right)\right) \times \mathrm{rem}\left(\frac{X}{8^n}\right) + Y_1 \times 16^n$$

$$\text{for } \mathrm{rem}\left(\frac{X}{8^n}\right) \le \frac{8^n}{2}$$

$$f(X) = \frac{1}{8^n} \times \left(16^n(Y_2 - Y_1) + 2f_a\left(\left\lfloor \frac{X}{8^n} \right\rfloor\right)\right) \times \left(\mathrm{rem}\left(\frac{X}{8^n}\right) - 8^n\right) + Y_2 \times 16^n$$

$$\text{for } \mathrm{rem}\left(\frac{X}{8^n}\right) > \frac{8^n}{2}$$

Wherein having $$z = \left\lfloor \frac{X}{8^n} \right\rfloor,$$

n=1 or 2, to have z fall in the data range S of the query table, and the function rem( ) represents the remainder-extraction operation. In addition, $$\frac{1}{8^n}$$

is the coefficient obtained by dividing the line segment linearly approached via the interpolation method into $8^n$ portions.

When the inverse package data X intended to be queried is greater than the data range S, the value of T(z) and T(z+1) are found from the query table and defined as $Y_1$ and $Y_2$, respectively, wherein z and (z+1) respectively fall in the data range S of the query table. Afterwards, $Y_1$ and $Y_2$ are further multiplied by a recover coefficient (here is $16^n$) to obtain the physical corresponding value of $X_1$ and $X_2$, i.e. f(X1) and f(X2), respectively, and the value of T(z) and T(z+1) are found from the query table and defined as $Y_1$ and $Y_2$, respectively. The maximum error quantity d in the interval $[X_1, X_2]$ is eliminated via the secant equation between two points of f(X1) and f(X2) and the modified error quantity function $f_a(z)$ provided by the present invention. The range from f(X1) and f(X2) is further divided into two segments to obtain the value of $f(X_3)$ that has the minimum error value, and the two-phase interpolation method is further performed.

The analyzing and obtaining of the modified error quantity function $f_a(z)$ provided by the present invention are described in detail hereinafter by referring to an error value statistic table (as shown in FIG. 4A) of the algorithm 1 used in the inverse quantization process.

Figure 5B:
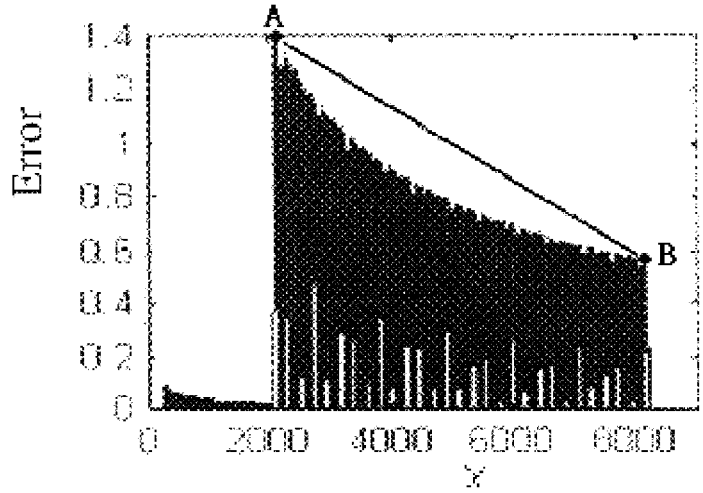
FIG. 5B schematically shows a conceptual graph of how to search the modified error quantity function $f_a(z)$ in the nonlinear operation method according to the present invention.

FIG. 5B schematically shows an error value statistic table of the algorithm 1 used in the inverse quantization process.

Step 1: Analyzing the error curve related to the nonlinear operation equation (i.e. the curve AB);

Step 2: Obtaining a linear equation of the error curve (i.e. the beeline AB);

Step 3: Providing a modified error quantity function $f_a(z)$ that adapts to the hardware design and eliminates the maximum error quantity (i.e. point A that is a maximum error quantity) for the linear equation via the try and error method. Wherein, the modified error quantity function $f_a(z)$ obtained is a simple or constant equation.

Assuming the linear equation of the point A and B obtained from the algorithm 1 is:

$$f_a(z) = \frac{z+b}{a}$$

Considering the hardware design, a number of $2^n$ that approaches to a is found and used to replace it, and the value of b is slightly modified to have the provided algorithm have smaller error at the maximum error point A. In the example of this segment in the present diagram, the modified function is shown as below:

$$f_a(z) = -(z-210)/2^7$$

After the concept of the present invention and the obtaining method of the modified error quantity function $f_a(z)$ has been described in detail, the method using the same will be described in detail hereinafter.

Figure 6A:
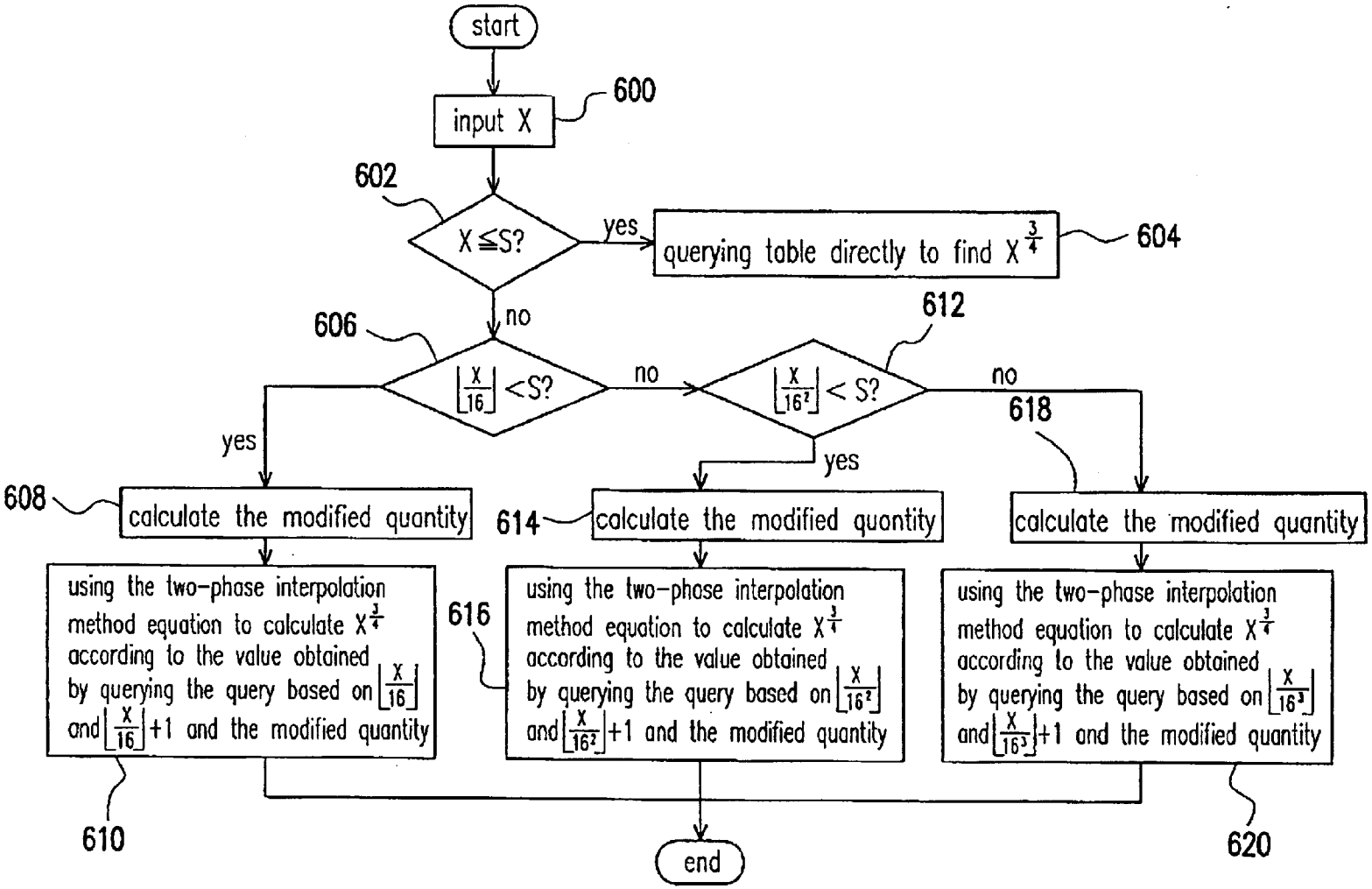
FIGS. 6A and 6B schematically show a flow chart of a nonlinear operation method suitable for the audio encoding/decoding according to the present invention, respectively.

FIG. 6A schematically shows a flow chart of a nonlinear operation method suitable for the audio encoding of a preferred embodiment according to the present invention, it exists in the audio encoding quantization process.

After the frequency-field data X is input (step 600), whether the frequency-field data X exists in the data range S of the built query table or not is determined in step 602. The query table comprises a plurality of frequency-field data X and the corresponding value f(X) that corresponds to the frequency-field data X. The query table is represented as T(X), and $T(X)=X^{3/4}$, $1 \leqq X \leqq S$, where S represents the data range included in the query table.

If the input frequency-field data X exists in the query table, the value of $f(X)=X^{3/4}$ corresponding to the frequency-field data X is obtained by querying from the query table (step 604). If the input frequency-field data X exists beyond the data range S of the query table, whether the gauss value $$\left\lfloor \frac{X}{16^1} \right\rfloor$$

exists in the data range S of the query table or not is determined under the condition n=1 in step 606. If $$\left\lfloor \frac{X}{16^1} \right\rfloor < S,$$

the modified error quantity is obtained by applying the steps of the method for obtaining the modified error quantity function $f_a(z)$ in FIG. 5B mentioned above (step 608), where $$z = \left\lfloor \frac{X}{16^1} \right\rfloor,$$

then the value obtained by querying the query table based on $$\left\lfloor \frac{X}{16^1} \right\rfloor$$

and $$\left\lfloor \frac{X}{16^1} \right\rfloor + 1$$

and the modified error quantity are used in the following equation (two-phase interpolation method) to calculate $X^{3/4}$ (step 610):

$$f(X) = \frac{1}{16^n} \times \left(8^n(Y_2 - Y_1) - 2f_a\left(\left\lfloor \frac{X}{16^n} \right\rfloor\right)\right) \times \mathrm{rem}\left(\frac{X}{16^n}\right) + Y_1 \times 8^n$$

$$\text{for } \mathrm{rem}\left(\frac{X}{16^n}\right) \leq \frac{16^n}{2}$$

$$f(X) = \frac{1}{16^n} \times \left(8^n(Y_2 - Y_1) + 2f_a\left(\left\lfloor \frac{X}{16^n} \right\rfloor\right)\right) \times \left(\mathrm{rem}\left(\frac{X}{16^n}\right) - 16^n\right) + Y_2 + 8^n$$

$$\text{for } \mathrm{rem}\left(\frac{X}{16^n}\right) > \frac{16^n}{2}$$

If $$\left\lfloor \frac{X}{16^1} \right\rfloor \geq S,$$

whether the gauss value $$\left\lfloor \frac{X}{16^2} \right\rfloor$$

exists in the data range S of the query table or not is determined under the condition n=2 in step 612. If $$\left\lfloor \frac{X}{16^2} \right\rfloor < S,$$

the modified error quantity is obtained by applying the method for obtaining the modified error quantity function $f_a(z)$ mentioned above (step 614), where $$z = \left\lfloor \frac{X}{16^2} \right\rfloor,$$

then the value obtained by querying the query table based on $$\left\lfloor \frac{X}{16^2} \right\rfloor \text{ and } \left\lfloor \frac{X}{16^2} \right\rfloor + 1$$

and the modified error quantity are used in the two-phase interpolation method equation to calculate $X^{3/4}$ (step 616).

It is determined in step 612 that $$\left\lfloor \frac{X}{16^2} \right\rfloor$$

is still greater than S, the modified error quantity of $$\left\lfloor \frac{X}{16^3} \right\rfloor$$

is calculated by using the method for obtaining the modified error quantity function $f_a(z)$ mentioned above under the condition n=3 in step 618, where $$z = \left\lfloor \frac{X}{16^3} \right\rfloor,$$

then the value obtained by querying the query table based on $$\left\lfloor \frac{X}{16^3} \right\rfloor$$

and $$\left\lfloor \frac{X}{16^3} \right\rfloor + 1$$

and the modified error quantity are used in the two-phase interpolation method equation to calculate $X^{3/4}$ (step 620).

The modified error quantity function $f_a(z)$ varies along with the variance of the power coefficient n and the data range S of the query table.

Assuming the size of the query table S=128, then $f_a(z)$ is as follows:

$$\text{if } n = 1,\ f_a(z) = \begin{cases} (z-34)/2^{11}, & \text{for } 8 \leq z \leq 33 \\ -1/2^{11}, & \text{for } 34 \leq z \leq 127 \end{cases}$$

$$\text{if } n = 2,\ f_a(z) = \begin{cases} (z-34)/2^{8}, & \text{for } 8 \leq z \leq 33 \\ -1/2^{8}, & \text{for } 34 \leq z \leq 127 \end{cases}$$

-continued $$\text{if } n=3,\ f_a(z)=\begin{cases}(z-34)/2^5, & \text{for } 8\le z\le 33\\ -1/2^3, & \text{for } 34\le z\le 40\end{cases}$$

Therefore, the f (X)=$X^{3/4}$ for 1≦X≦165113 is obtained.

Assuming the size of the query table S=64, then $f_a(z)$ is as follows:

$$\text{if } n=1,\ f_a(z)=\begin{cases}(z-19)/2^9, & \text{for } 4\le z\le 18\\ \frac{-1}{2^{10}}, & \text{for } 19\le z\le 63\end{cases}$$

$$\text{if } n=2,\ f_a(z)=\begin{cases}(z-19)/2^6, & \text{for } 4\le z\le 18\\ \frac{-1}{2^7}, & \text{for } 19\le z\le 63\end{cases}$$

$$\text{if } n=3,\ f_a(z)=\begin{cases}(z-19)/2^3, & \text{for } 4\le z\le 18\\ \frac{-1}{2^4}, & \text{for } 19\le z\le 63\end{cases}$$

Therefore, the f(X)=$X^{3/4}$ for 1≦X≦165113 is obtained.

Figure 6B:
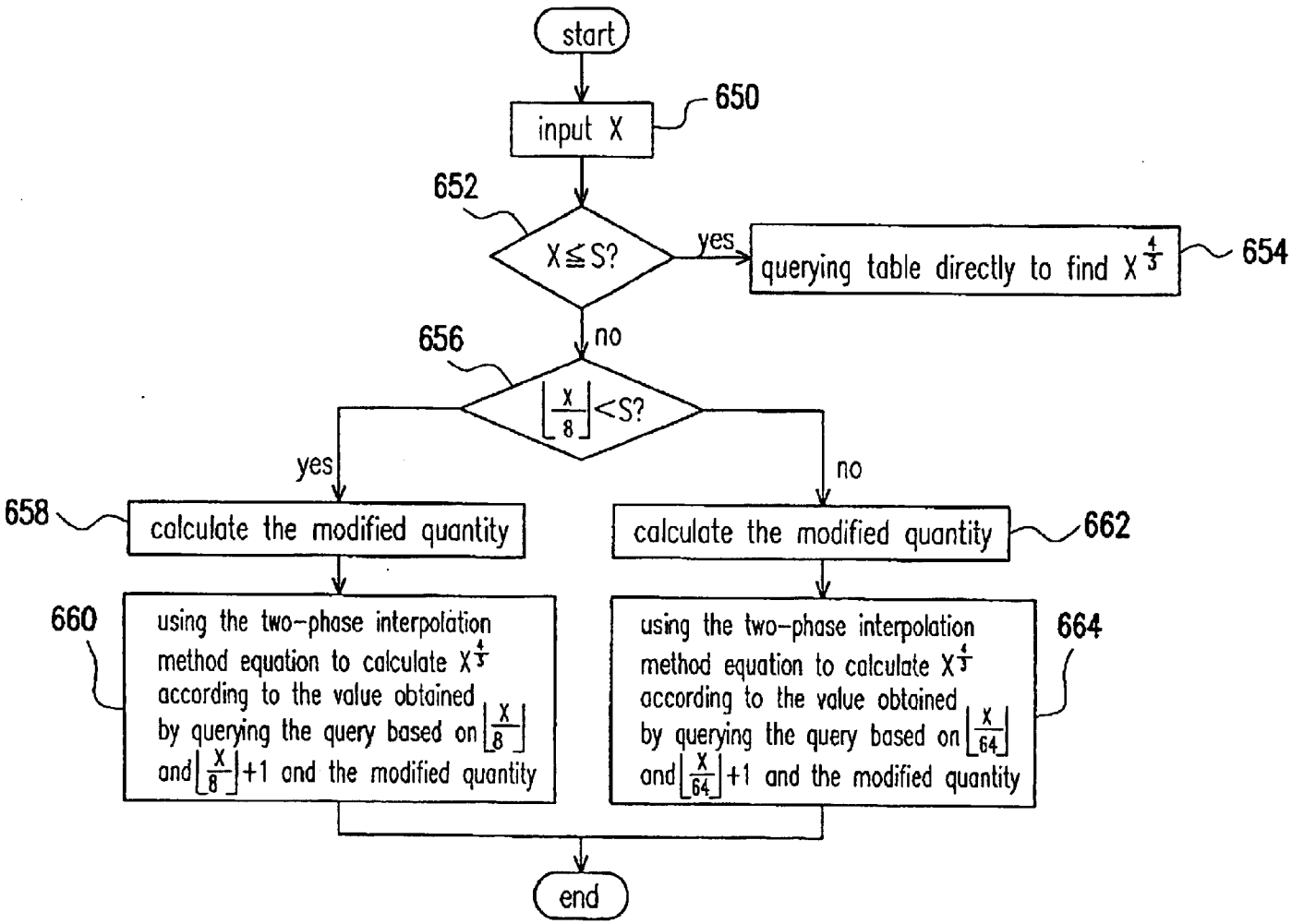

FIG. 6B schematically shows a flow chart of a nonlinear operation method suitable for the audio decoding of another preferred embodiment according to the present invention, it exists in the audio decoding inverse quantization process.

After the inverse package data X is input (step 650), whether the inverse package data X exists in the data range S of the built query table or not is determined in step 652. The query table comprises a plurality of inverse package data X and the corresponding value f(X) that corresponds to the inverse package data X. The query table is represented as T(X), and T(X)=$X^{4/3}$, 1≦X≦S. where S represents the data range included in the query table.

If the input inverse package data X exists in the query table, the value of f(X)=$X^{4/3}$ corresponding to the inverse package data X is obtained by querying from the query table (step 654). If the input inverse package data X exists beyond the data range S of the query table, whether the gauss value $$\left\lfloor \frac{X}{8^1} \right\rfloor$$

exists in the data range S of the query table or not is determined under the condition n=1 in step 656. If $$\left\lfloor \frac{X}{8^1} \right\rfloor < S,$$

the modified error quantity is obtained by applying the steps of the method for obtaining the modified error quantity function $f_a(z)$ mentioned above (step 658), where $$z=\left\lfloor \frac{X}{8^1} \right\rfloor,$$

then the value obtained by querying the query table based on $$\left\lfloor \frac{X}{8^1} \right\rfloor \text{ and } \left\lfloor \frac{X}{8^1} \right\rfloor + 1$$

and the modified error quantity are used in the following equation (two-phase interpolation method) to calculate $X^{4/3}$ (step 660):

$$f(X)=\frac{1}{8^n}\times\left(16^n(Y_2-Y_1)-2f_a\left(\left\lfloor \frac{X}{8^1}\right\rfloor\right)\right)\times \mathrm{rem}\left(\frac{X}{8^n}\right)+Y_1\times 16^n$$

$$\text{for } \mathrm{rem}\left(\frac{X}{8^n}\right)\le \frac{8^n}{2}$$

$$f(X)=\frac{1}{8^n}\times\left(16^n(Y_2-Y_1)+2f_a\left(\left\lfloor \frac{X}{8^n}\right\rfloor\right)\right)\times\left(\mathrm{rem}\left(\frac{X}{8^n}\right)-8^n\right)+Y_2\times 16^n$$

$$\text{for } \mathrm{rem}\left(\frac{X}{8^n}\right)> \frac{8^n}{2}$$

If $$\left\lfloor \frac{X}{8^1} \right\rfloor > S,$$

the modified error quantity of $$\left\lfloor \frac{X}{8^2} \right\rfloor$$

is obtained by applying the method for obtaining the modified error quantity function $f_a(z)$ mentioned above (step 662), where $$z=\left\lfloor \frac{X}{8^2} \right\rfloor,$$

then the value obtained by querying the query table based on $$\left\lfloor \frac{X}{8^2} \right\rfloor \text{ and } \left\lfloor \frac{X}{8^2} \right\rfloor + 1$$

and the modified error quantity are used in the two-phase interpolation method equation to calculate $X^{4/3}$ (step 664).

The modified error quantity function $f_a(z)$ varies along with the variance of the power coefficient n and the data range S of the query table.

Assuming the size of the query table S=256, then $f_a(z)$ is as follows:

if n=1, $f_a(z)=-(z-362)/2^{12}$, for 32≦z≦255 if n=2, $f_a(z)=-(z-210)/2^7$, for 32≦z≦127

Therefore, the f(X)=$X^{4/3}$ for 1≦X≦8191 is obtained.

Assuming the size of the query table S=128, then $f_a(z)$ is as follows:

if n=1, $f_a(z)=-(z-153)/2^{10}$, for 16≦z≦127 if n=2, $f_a(z)=-(z-154)/2^6$, for 16≦z≦127

Therefore, the f(X)=$X^{4/3}$ for 1≦X≦8191 is obtained.

Figure 7:
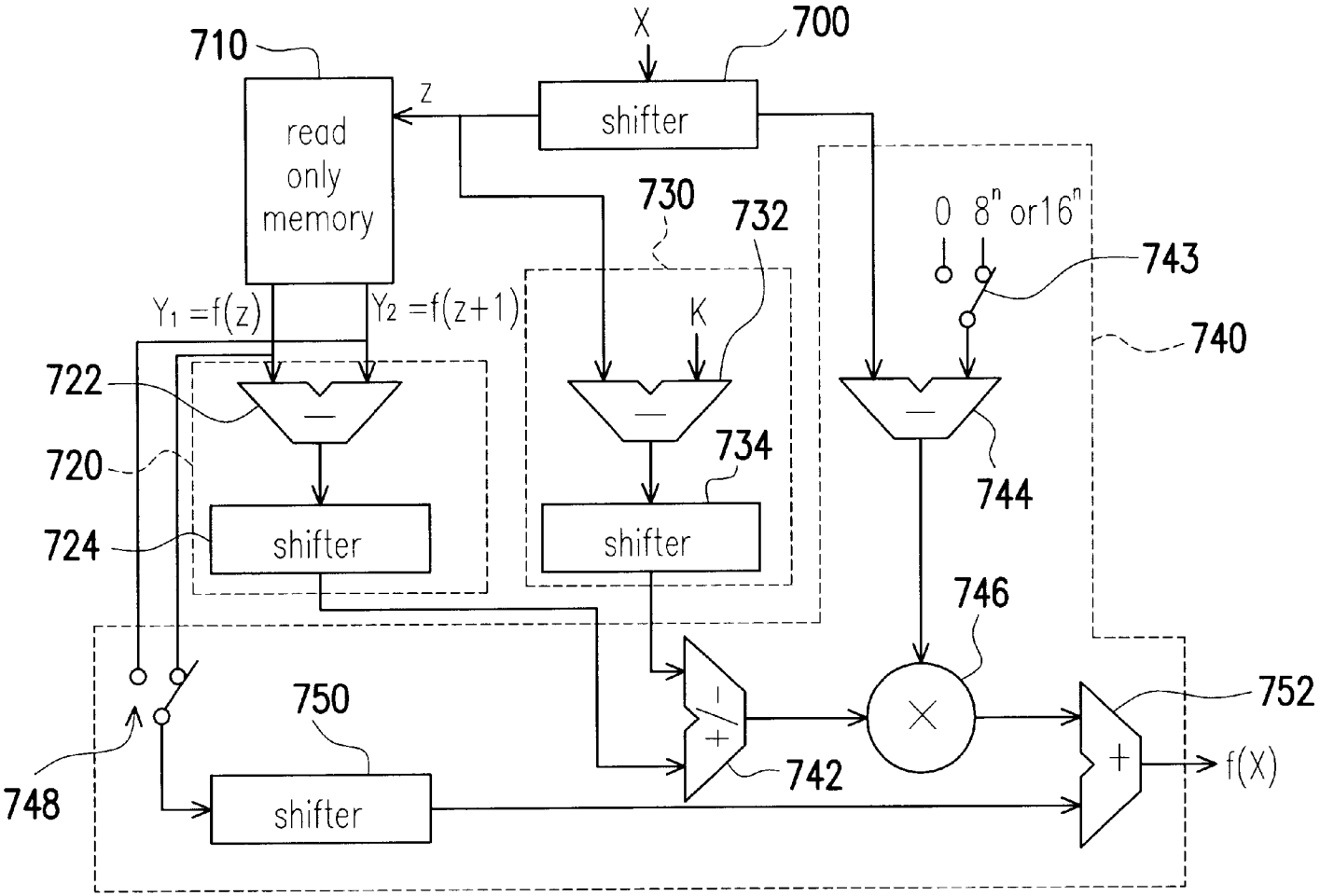
FIG. 7 schematically shows a circuit diagram of an applied hardware for the nonlinear operation suitable for the audio encoding/decoding according to the present invention.

FIG. 7 schematically shows an applied hardware for the nonlinear operation suitable for the audio encoding/decoding system according to the present invention. The applied hardware exists in the MPEG integrated circuit, and is used to solve the nonlinear operation equation needed in the quantization/inverse quantization process. The applied hardware used to implement the two-phase interpolation method provided by the present invention comprises a shifter 700, a read only memory 710, a difference calculator 720, a modified error quantity function generator 730, and an interpolation method calculator 740. The two-phase interpolation method equations used in the inverse quantization are exemplified below for description:

$$f(X)=\frac{1}{8^n}\times\left(16^n(Y_2-Y_1)-2f_a\left(\left\lfloor\frac{X}{8^n}\right\rfloor\right)\right)\times\mathrm{rem}\left(\frac{X}{8^n}\right)+Y_1\times 16^n$$

$$\text{for } \mathrm{rem}\left(\frac{X}{8^n}\right)\le\frac{8^n}{2}$$

$$f(X)=\frac{1}{8^n}\times\left(16^n(Y_2-Y_1)+2f_a\left(\left\lfloor\frac{X}{8^n}\right\rfloor\right)\right)\times\left(\mathrm{rem}\left(\frac{X}{8^n}\right)-8^n\right)+Y_2\times 16^n$$

$$\text{for } \mathrm{rem}\left(\frac{X}{8^n}\right)>\frac{8^n}{2}$$

The shifter 700 receives the sampling data X, wherein the sampling data X is either the frequency-field data in the quantization process or the inverse package data in the inverse quantization process. The operation sampling data $$z=\left\lfloor\frac{X}{8^n}\right\rfloor$$

is obtained after the right-shift operation $$\left\lfloor\frac{X}{8^n}\right\rfloor$$

is applied (since it is a number of power of 2, the shift method can be used directly to perform the calculation) to have the operation sampling data z fall in the data range S.

The read only memory 710 stores the query table that includes the data range S, and the query table is represented by the function T(X). The read only memory 710 outputs the value of T(z) and T(z+1) after receiving the operation sampling data z and defines them as $Y_1$ and $Y_2$, respectively, wherein z and (z+1) fall in the data range S of the query table, respectively.

The difference calculator 720 coupled to the read only memory 710 is used to receive $Y_1$ and $Y_2$ and obtain a difference of $(Y_2-Y_1)$ by using the subtractor 722. Moreover, the difference is multiplied by a power of 2 operation, i.e. $16^n$, to output an original difference.

After the operation sampling data z is received by the modified error quantity function generator 730 that is coupled to the shifter 700, a modified error quantity function $f_a(z)$ is obtained after performing the subtraction operation (the subtractor 732) and shift operation (the shifter 734). The reason for performing the subtraction operation (the subtractor 732) and shift operation (the shifter 734) is because the modified error quantity function $f_a(z)$ is a simple or constant equation. Therefore, the subtraction operation is the only operation needed for the constant K, and the shift operation is the only operation needed for the power of 2.

Optionally, the equal portion $$\frac{1}{8^n}$$

that is needed for the interpolation can be merged to the difference calculator 720 and the modified error quantity function generator 730 respectively to perform the shift operation, so as to save the usage of the shifter circuit.

The interpolation method calculator 740 receives the original difference $16^n(Y_2-Y_1)$ and the modified error quantity function $f_z(z)$ to perform the summation/subtraction operation, the coefficient multiply operation, and the shift operation, so as to obtain the nonlinear operation corresponding value of the sampling data X. Moreover, the following result is obtained after applying the summation/subtraction operation (the adder/subtractor 742):

$$\frac{1}{8^n}\times(16^n(Y_2-Y_1)-2f_a(z))\ \text{ or} \tag{a}$$

$$\frac{1}{8^n}\times(16^n(Y_2-Y_1)+2f_a(z)) \tag{b}$$

The subtraction process (the subtractor 744) receives the remainder value of $$\frac{X}{8^n}$$

(i.e. the value of $$\mathrm{rem}\left(\frac{X}{8^n}\right)$$

via the shifter 700 in the inverse quantization. After knowing the input X is in which equal portion and selecting (the selector 743) 0, cooperating with each equal portion value in the interpolation operation obtained from the equation (a) mentioned above, and via the multiplier operation unit 746 to obtain $$\frac{1}{8^n}\times(16^n(Y_2-Y_1)-2f_a(z))\times\mathrm{rem}\left(\frac{X}{8^n}\right).$$

If selecting (the selector 743) $8^n$, cooperating with the equation (b) to obtain $$\frac{1}{8^n}\times(16^n(Y_2-Y_1)+2f_a(z))\times\left(\mathrm{rem}\left(\frac{X}{8^n}\right)-8^n\right).$$

The original corresponding value of $Y_1$ or $Y_2$ obtained after the operation of the selector 748 and the left-shift shifter 750 is $Y_1\times16^n$ or $Y_2\times16^n$. Afterwards, the following operation equation is further obtained by cooperating with the operation of the adder 752: f(X)=

$$\frac{1}{8^n}\times(16^n(Y_2-Y_1)-2f_a(z))\times\mathrm{rem}\left(\frac{X}{8^n}\right)+Y_1\times16^n\ \text{ or}$$

$$\frac{1}{8^n}\times(16^n(Y_2-Y_1)-2f_a(z))\times\left(\mathrm{rem}\left(\frac{X}{8^n}\right)-8^n\right)+Y_2\times16^n$$

The present invention only uses one multiplier circuit, i.e. the multiplier 746. However, if the operation circuit is considered from the algorithm 2 point of view, a multiplier circuit has to be added after the adder 752 has added, so as to obtain the corresponding value f(X). Since the algorithm 2 translates $X^{4/3}$ into $$\left[\frac{X}{8}\right]^{\frac{1}{3}}\times2\times X,$$

besides using a multiplier in the process of obtaining $$\left[\frac{X}{8}\right]^{\frac{1}{3}},$$

an additional multiplier is further needed for multiplying a value, so as to obtain the value of $X^{4/3}$.

Table 1 shown below schematically shows the error analysis in the quantization process of the algorithm 1 and the present invention, where S=64 in the query table.

TABLE 1

| Error value | Algorithm 1 | Present Invention |
|---|---|---|
| Maximum error (X = 65~1024) | 0.012929 | 0.003470 |
| Maximum error (X = 1025~16384) | 0.10345 | 0.02777 |
| Maximum error (X = 16385~165113) | 0.82761 | 0.22213 |
| Average error | −0.158628 | −0.011615 |
| Standard error value | 0.226086 | 0.056632 |

Table 2 shown below schematically shows the error analysis in the inverse quantization process of the algorithm 1, 2 and the present invention, where S=256 in the query table.

TABLE 2

| Error value | Algorithm 1 | 2 | Present Invention |
|---|---|---|---|
| Maximum error (X = 257~2048) | 0.08728 | 0.04365 | 0.02538 |
| Maximum error (X = 2049~8191) | 1.39655 | 0.69832 | 0.35389 |
| Average error | 0.41979 | −0.20990 | 0.03161 |
| Standard error value | 0.54307 | 0.27154 | 0.09628 |

It is apparent from Table 1 and Table 2 shown above that the error value range of the present invention is smaller than in the conventional algorithm in both quantization process and inverse quantization process.

In summary, the present invention has following advantages:

1. Simplify the algorithm process
2. Facilitate the hardware implementation
3. Small error range
4. No need to add an additional multiplier circuit Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A nonlinear operation method suitable for audio encoding, existing in a quantization process for audio encoding, the nonlinear operation equation is $f(X) = X^{3/4}$, wherein X represents a frequency-field data, and the nonlinear operation method suitable for audio encoding comprising:

building up a query table, the query table comprising a plurality of frequency-field data X and a plurality of corresponding values f(X) that correspond to the frequency-field data X, wherein the query table is represented as a function T(X), and $T(X)=X^{3/4}$, $1 \leqq X \leqq S$, where S represents a data range included in the query table;

analyzing and providing a modified error quantity function $f_a(z)$ represented by a power of 2 equation, wherein let $$z = \left\lfloor \frac{X}{16^n} \right\rfloor,$$

n=1, 2 or 3 to have z fall in the data range S of the query table;

wherein when the frequency-field data X that is intended to query is greater than the data range S, the values of T(z) and T(z+1) are obtained from the query table and are defined as $Y_1$ and $Y_2$, respectively, where z and (z+1) fall in the data range S of the query table, respectively; and calculating a corresponding value f(X) of any one of the frequency-field data X that is beyond the data range S by using a two-phase interpolation method, comprising the steps of:

multiplying $Y_1$ and $Y_2$ by a recover coefficient respectively to obtain a corresponding value of $X_1$ and $X_2$, i.e. f(X1) and f(X2), respectively;

generating a secant equation that passes through two points of f(X1) and f(X3);

eliminating a maximum error quantity in a $[X_1, X_2]$ interval via the modified error quantity function $f_a(z)$ according to the secant equation, so as to divide a range from f(X1) to f(X2) into two segments, and to obtain a value of $f(X_3)$ that has a minimum error;

obtaining a corresponding value f(X) of any one of the frequency-field data X in an $[X_1, X_3]$ interval via the interpolation method; and obtaining a corresponding value f(X) of any one of the frequency-field data X in an $[X_3, X_2]$ interval via the interpolation method.

2. The nonlinear operation method suitable for audio encoding of claim 1, wherein the modified error quantity function $f_a(z)$ is a simple or constant equation.

3. The nonlinear operation method suitable for audio encoding of claim 2, wherein the steps for obtaining the modified error quantity function $f_a(z)$ comprising:

analyzing and obtaining an error curve related to the nonlinear operation equation;

obtaining a linear equation of the error curve; and providing the modified error quantity function $f_a(z)$ that can adapt to the hardware design and is able to eliminate the maximum error quantity by using the trial and error method.

4. The nonlinear operation method suitable for audio encoding of claim 3, wherein the modified error quantity function $f_a(z)$ varies along with the variance of the nth power coefficient and the data range S of the query table.

5. The nonlinear operation method suitable for audio encoding of claim 1, further comprising:

wherein when the frequency-field data $X \leqq$ the data range S, a value of T(X) corresponding to the frequency-field data X that is smaller than or equal to the data range S is obtained by querying the query table.

6. A nonlinear operation method suitable for audio decoding, existing in an inverse quantization process for audio decoding, the nonlinear operation equation is $f(X)=X^{4/3}$, wherein X represents an inverse package data, and the nonlinear operation method suitable for audio decoding comprising:

building up a query table, the query table comprising a plurality of inverse package data X and a plurality of corresponding values f(X) that correspond to the inverse package data X, wherein the query table is represented as a function T(X), and $T(X)=X^{4/3}$, $1 \leqq X \leqq S$, where S represents a data range included in the query table;

analyzing and providing a modified error quantity function $f_a(z)$ represented by a power of 2 equation, wherein let $$z = \left\lfloor \frac{X}{8^n} \right\rfloor,$$

n=1 or 2 to have z fall in the data range S of the query table;

wherein when the inverse package data X that is intended to query is greater than the data range S, the values of T(z) and T(z+1) are obtained from the query table and are defined as $Y_1$ and $Y_2$, respectively, where z and (z+1) fall in the data range S of the query table, respectively; and calculating a corresponding value f(X) of any one of the inverse package data X that is beyond the data range S by using a two-phase interpolation method, comprising the steps of:

multiplying $Y_1$ and $Y_2$ by a recover coefficient to obtain a corresponding value of $X_1$ and $X_2$, i.e. f(X1) and f(X2), respectively;

generating a secant equation that passes through two points of f(X1) and f(X2);

eliminating a maximum error quantity in an $[X_1, X_2]$ interval via the modified error quantity function $f_a(z)$ according to the secant equation, so as to divide a range from f(X1) to f(X2) into two segments, and to obtain a value of $f(X_3)$ that has a minimum error;

obtaining a corresponding value f(X) of any one of the inverse package data X in an $[X_1, X_3]$ interval via the interpolation method; and obtaining a corresponding value f(X) of any one of the inverse package data X in an $[X_3, X_2]$ interval via the interpolation method.

7. The nonlinear operation method suitable for audio decoding of claim 6, wherein the modified error quantity function $f_a(z)$ is a simple or constant equation.

8. The nonlinear operation method suitable for audio decoding of claim 6, wherein the steps for obtaining the modified error quantity function $f_a(z)$ comprising:

analyzing and obtaining an error curve related to the nonlinear operation equation;

obtaining a linear equation of the error curve; and providing the modified error quantity function $f_a(z)$ that can adapt to the hardware design and is able to eliminate the maximum error quantity by using the trial and error method.

9. The nonlinear operation method suitable for audio decoding of claim 8, wherein the modified error quantity function $f_a(z)$ varies along with the variance of the nth power coefficient and the data range S of the query table.

10. The nonlinear operation method suitable for audio decoding of claim 6, further comprising:

wherein when the inverse package data $X \leqq$ the data range S, a value of T(X) corresponding to the inverse package data X that is smaller than or equal to the data range S obtained by querying the query table.

11. An applied hardware of a nonlinear operation suitable for audio encoding/decoding, the applied hardware existing in a MPEG integrated circuit is used to solve a nonlinear operation equation needed in a quantization/inverse quantization process, and the applied hardware of the nonlinear operation suitable for audio encoding/decoding comprising:

a shifter, receiving a sampling data X, obtaining an operation sampling data z after applying a right-shift operation to have the operation sampling data z fall in a data range S;

a read only memory, storing a query table that includes the data range S, wherein the query table is represented as a function T(X), the read only memory outputs a value of T(z) and T(z+1) after receiving the operation sampling data z and defining them as $Y_1$ and $Y_2$, respectively, where z and (z+1) fall in the data range S of the query table, respectively;

a difference calculator, coupled to the read only memory, receiving $Y_1$ and $Y_2$ to obtain a difference of $(Y_2-Y_1)$, and applying a power of 2 operation onto the difference to output an original difference;

a modified error quantity function generator, coupled to the shifter, receiving the operation sampling data z, and obtaining a modified error quantity function $f_a(z)$ after applying a subtraction and shift operation; and an interpolation method calculator, receiving the original difference and the modified error quantity function $f_a(z)$, and performing a summation/subtraction operation, a selection process, a coefficient multiply operation, and a shift operation to obtain a nonlinear operation corresponding value of the sampling data X.

12. The applied hardware of the nonlinear operation suitable for audio encoding/decoding of claim 11, wherein the modified error quantity function $f_a(z)$ is a simple or constant equation.

* * * * *